US009546611B2

(12) United States Patent
Daniels et al.

(10) Patent No.: US 9,546,611 B2
(45) Date of Patent: Jan. 17, 2017

(54) M INDEX DETERMINATION SYSTEMS AND METHODS FOR WIEBE FUNCTIONS

(71) Applicant: GM Global Technology Operations LLC, Detroit, MI (US)

(72) Inventors: Chao F. Daniels, Superior Township, MI (US); Xu Han, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 270 days.

(21) Appl. No.: 14/525,297

(22) Filed: Oct. 28, 2014

(65) Prior Publication Data

US 2016/0115877 A1 Apr. 28, 2016

(51) Int. Cl.

*F02D 35/00* (2006.01)
*F02D 35/02* (2006.01)
*F02D 37/02* (2006.01)

(52) U.S. Cl.

CPC ..... *F02D 35/028* (2013.01); *F02D 35/023* (2013.01); *F02D 35/025* (2013.01); *F02D 37/02* (2013.01)

(58) Field of Classification Search

CPC .... F02D 35/023; F02D 35/024; F02D 35/025; F02D 35/026; F02D 35/028
USPC ..... 701/102; 123/406.41–406.43, 435
See application file for complete search history.

(56) References Cited

U.S. PATENT DOCUMENTS 7,277,790 B1 * 10/2007 Green, Jr. ..... F02B 77/085 701/105
8,843,295 B2 9/2014 Santoso et al.
2010/0241333 A1 * 9/2010 Moriya ..... F02D 11/10 701/101
2014/0257670 A1 * 9/2014 Tsuchiya ..... F02D 41/1401 701/102
2015/0142294 A1 * 5/2015 Hagari ..... G01M 15/08 701/101
2016/0237923 A1 * 8/2016 Kitagawa ..... F02D 35/023

* cited by examiner

*Primary Examiner* — Erick Solis

(57) ABSTRACT

A parameter determination system includes first and second difference modules, a ratio module, and an M index module. The first difference module determines a first crankshaft angle of a combustion event of an engine, determines a second crankshaft angle of the combustion event of the engine, and determines a first difference between the first and second crankshaft angles. The second difference module determines a third crankshaft angle of the combustion event of the engine, determines a fourth crankshaft angle of the combustion event of the engine, and determines a second difference between the third and fourth crankshaft angles. The ratio module determines a ratio of the first difference to the second difference. The M index module determines an M index value for the Wiebe function based on the ratio and displays the M index value on a display.

20 Claims, 5 Drawing Sheets

M INDEX DETERMINATION SYSTEMS AND METHODS FOR WIEBE FUNCTIONS

FIELD

The present disclosure relates to internal combustion engines of vehicles and more particularly to systems and methods for determining the M index value of Wiebe functions for engine simulations.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. In some types of engines, air flow into the engine may be regulated via a throttle. The throttle may adjust throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

Combustion of an air/fuel mixture within a cylinder begins when a spark plug generates spark within the cylinder. The mass fraction of fuel burned during a combustion event may be referred to as mass fraction burned (MFB). Various parameters for where various MFBs occur may be used to evaluate how fast the combustion event occurs. For example, a crankshaft angle (CA) where 50 percent of a mass of fuel has been burned during a combustion event is referred to as CA50.

SUMMARY

A parameter determination system includes first and second difference modules, a ratio module, and an M index module. The first difference module determines a first crankshaft angle of a combustion event of an engine, determines a second crankshaft angle of the combustion event of the engine, and determines a first difference between the first and second crankshaft angles. The second difference module determines a third crankshaft angle of the combustion event of the engine, determines a fourth crankshaft angle of the combustion event of the engine, and determines a second difference between the third and fourth crankshaft angles. The ratio module determines a ratio of the first difference to the second difference. The M index module determines an M index value for the Wiebe function based on the ratio and displays the M index value on a display.

In further features, the ratio module sets the ratio equal to the first difference divided by the second difference.

In further features, the first difference module sets the first crankshaft angle based on a crankshaft angle where a mass fraction burned of 0.1 occurred during the combustion event.

In further features, the first difference module sets the second crankshaft angle based on a crankshaft angle where a mass fraction burned of 0.75 occurred during the combustion event.

In further features, the second difference module sets the third crankshaft angle to a spark timing used for the combustion event.

In further features, the second difference module sets the fourth crankshaft angle based on a crankshaft angle where a mass fraction burned of 0.5 occurred during the combustion event.

In further features, the first difference module sets the first crankshaft angle based on a crankshaft angle where a mass fraction burned of 0.1 occurred during the combustion event and sets the second crankshaft angle based on a crankshaft angle where a mass fraction burned of 0.75 occurred during the combustion event. The second difference module sets the third crankshaft angle to a spark timing used for the combustion event and sets the fourth crankshaft angle based on a crankshaft angle where a mass fraction burned of 0.5 occurred during the combustion event.

In further features, a maximum velocity module determines a crankshaft angle where a maximum velocity occurred during the combustion event based on the M index value.

In further features, a maximum acceleration module determines a crankshaft angle where a maximum acceleration occurred during the combustion event based on the M index value.

In further features, a minimum acceleration module determines a crankshaft angle where a minimum acceleration occurred during the combustion event based on the M index value.

A parameter determination method includes: determining a first crankshaft angle of a combustion event of an engine; determining a second crankshaft angle of the combustion event of the engine; determining a first difference between the first and second crankshaft angles; determining a third crankshaft angle of the combustion event of the engine; determining a fourth crankshaft angle of the combustion event of the engine; determining a second difference between the third and fourth crankshaft angles; determining a ratio of the first difference to the second difference; determining an M index value for the Wiebe function based on the ratio; and displaying the M index value on a display.

In further features, the parameter determination method further includes setting the ratio equal to the first difference divided by the second difference.

In further features, the parameter determination method further includes setting the first crankshaft angle based on a crankshaft angle where a mass fraction burned of 0.1 occurred during the combustion event.

In further features, the parameter determination method further includes setting the second crankshaft angle based on a crankshaft angle where a mass fraction burned of 0.75 occurred during the combustion event.

In further features, the parameter determination method further includes setting the third crankshaft angle to a spark timing used for the combustion event.

In further features, the parameter determination method further includes setting the fourth crankshaft angle based on a crankshaft angle where a mass fraction burned of 0.5 occurred during the combustion event.

In further features, the parameter determination method further includes: setting the first crankshaft angle based on a crankshaft angle where a mass fraction burned of 0.1 occurred during the combustion event; setting the second crankshaft angle based on a crankshaft angle where a mass fraction burned of 0.75 occurred during the combustion event; setting the third crankshaft angle to a spark timing used for the combustion event; and setting the fourth crankshaft angle based on a crankshaft angle where a mass fraction burned of 0.5 occurred during the combustion event.

In further features, the parameter determination method further includes determining a crankshaft angle where a maximum velocity occurred during the combustion event based on the M index value.

In further features, the parameter determination method further includes determining a crankshaft angle where a maximum acceleration occurred during the combustion event based on the M index value.

In further features, the parameter determination method further includes determining a crankshaft angle where a minimum acceleration occurred during the combustion event based on the M index value.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
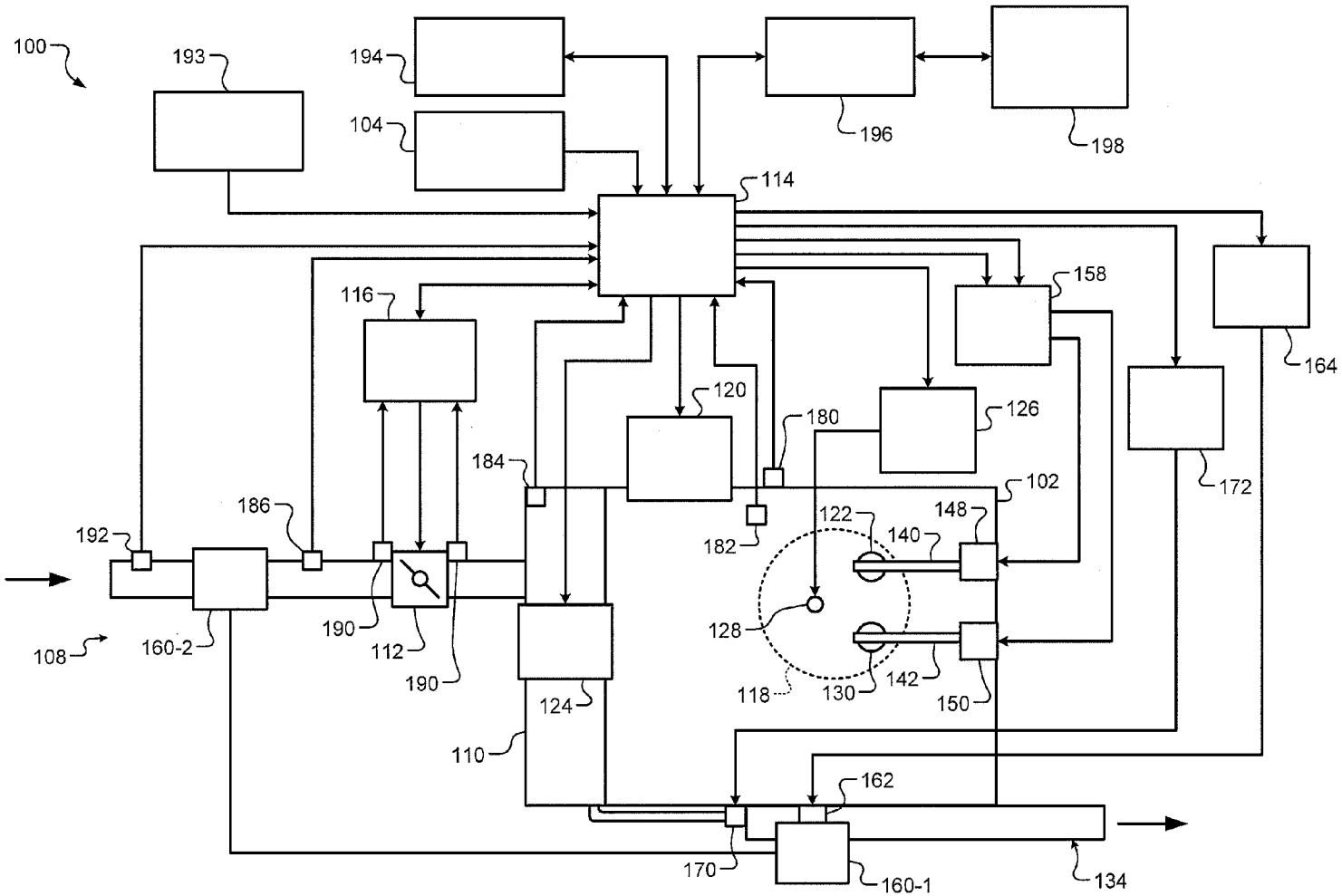
FIG. 1 is a functional block diagram of an example engine system.

Internal combustion engines combust an air and fuel mixture within cylinders to generate torque. Combustion within a cylinder begins when a spark plug generates spark within the cylinder. The fuel is combusted over time until all of the fuel has been burned.

Based on parameters measured during combustion of the fuel, a mapping of mass fraction burned (MFB) values at various crankshaft angles can be generated. MFB values indicate the fraction of a mass of fuel that has been burned during a combustion event.

The Wiebe function can be used to determine the MFB at a crankshaft angle given a spark timing used for a combustion event and knowing an M index value. The M index value can be found by fitting a curve (e.g., using non-linear least squares fitting) to a set of MFBs at various crankshaft angles (CAs). Determining the M index value in this way, however, is difficult and requires a relatively large number of points to increase the accuracy of the M index value determined.

According to the present disclosure, a parameter determination module determines the M index value based on a ratio of a first crankshaft angle difference to a second crankshaft angle difference during the combustion event. The first crankshaft angle difference is determined based on a difference between a first crankshaft angle of the combustion event and a second crankshaft angle of the combustion event. For example, the first crankshaft angle may be the crankshaft angle where 10 percent of the fuel has been combusted during the combustion event (i.e., CA10 or MFB=0.1). The second crankshaft angle may be the crankshaft angle where 75 percent of the fuel has been combusted during the combustion event (i.e., CA75 or MFB=0.75).

The second crankshaft angle difference is determined based on a difference between third and fourth crankshaft angles of the combustion event. For example, the third crankshaft angle may be the crankshaft angle where spark was generated for the combustion event (i.e., the spark timing). The fourth crankshaft angle may be the crankshaft angle where 50 percent of the fuel has been combusted during the combustion event (i.e., CA50 or MFB=0.5).

The parameter determination module may determine one or more other parameters based on the M index value. For example, the parameter determination module may determine a crankshaft angle where a maximum crankshaft velocity occurred during the combustion event based on the M index value. The parameter determination module may additionally or alternatively determine a crankshaft angle where a maximum crankshaft acceleration occurred during the combustion event based on the M index value. The parameter determination module may additionally or alternatively determine a crankshaft angle where a minimum crankshaft acceleration occurred during the combustion event based on the M index value. One or more of the determined parameters may be displayed, such as on a display, and may be used during vehicle design and/or calibration.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle or another suitable engine cycle. The four strokes of a four-stroke cycle, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. For four-stroke engines, one engine cycle may correspond to two crankshaft revolutions.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft based valve actuation is shown and has been discussed, camless valve actuators may be implemented.

The cylinder actuator module 120 may deactivate the cylinder 118 by disabling opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than a camshaft, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. An engine speed may be determined based on the crankshaft position measured using the crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193, such as cylinder pressure sensors. The ECM 114 may use signals from the sensors to make control decisions for the engine system 100.

The ECM 114 may communicate with a transmission control module 194 to coordinate shifting gears in the transmission. For example, the ECM 114 may reduce engine torque during a gear shift. The ECM 114 may communicate with a hybrid control module 196 to coordinate operation of the engine 102 and an electric motor 198. The electric motor 198 may also function as a generator, and may be used to produce electrical energy for use by vehicle electrical systems and/or for storage in a battery. While only the electric motor 198 is shown and discussed, multiple electric motors may be implemented. In various implementations, various functions of the ECM 114, the transmission control module 194, and the hybrid control module 196 may be integrated into one or more modules.

Figure 2:
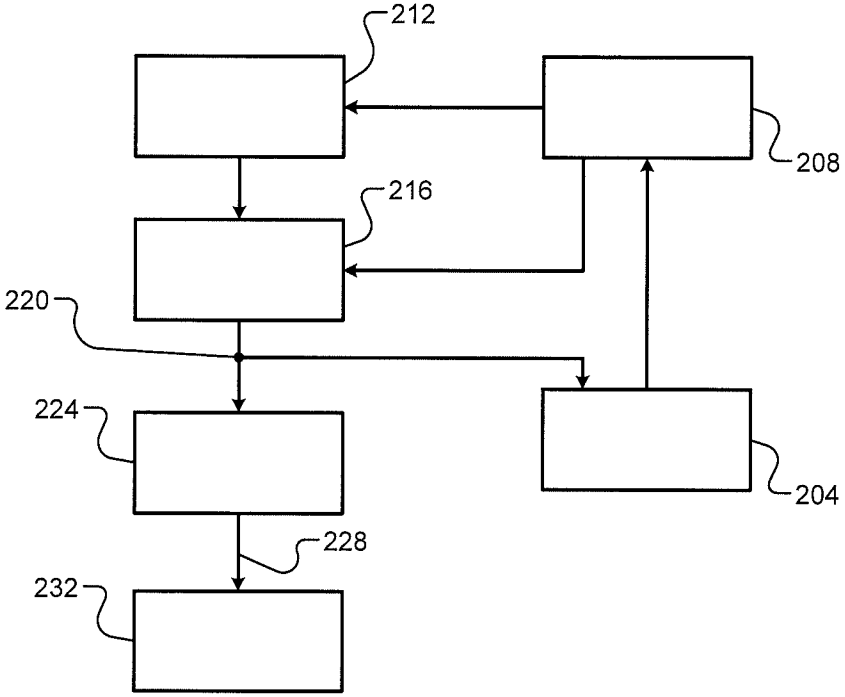
FIG. 2 is a functional block diagram of a data acquisition system.

FIG. 2 includes a functional block diagram of an example data acquisition system. A control module 204 controls operation of an engine 208 under test using a dynamometer 212. The control module 204 may control operation of the engine 208 according to a predetermined schedule for the test.

One or more sensors 216 are associated with the engine 208 and the dynamometer 212. The sensors 216 measure engine operating parameters and provide signals 220 to a mapping module 224 based on the measured parameters. For example, a crankshaft position sensor may measure crankshaft position. A cylinder pressure sensor may be provided for each cylinder.

The mapping module 224 generates a heat release profile for a combustion event of a cylinder based on measurements from the sensors 216 during the combustion event. An example of generating heat release profiles is described in commonly assigned U.S. patent Ser. No. 12/472,747, which is published as U.S. Pub. No. 2010/0305829, both of which are incorporated herein in their entirety.

More specifically, the mapping module 224 generates a mapping 228 of crankshaft angle (CA) versus mass fraction burned (MFB) for the combustion event based on measurements from the sensors 216 during the combustion event. An MFB corresponds to a fraction of a mass fuel that has been combusted during a combustion event. In other words, an MFB corresponds to a ratio of a mass of fuel that has been combusted during the combustion event relative to a total mass of fuel injected for the combustion event. As such, MFBs are values between 0.0 and 1.0, inclusive. An MFB 0.0 indicates that combustion has not yet begun, and an MFB of 1.0 indicates that all of the fuel has been combusted. The mapping module 224 may determine the MFBs, for example, based on pressures measured at various crankshaft positions, respectively, during the combustion event. The mapping module 224 may determine the MFBs, for example, using one or more functions or mappings (e.g., look-up tables).

Figure 3:
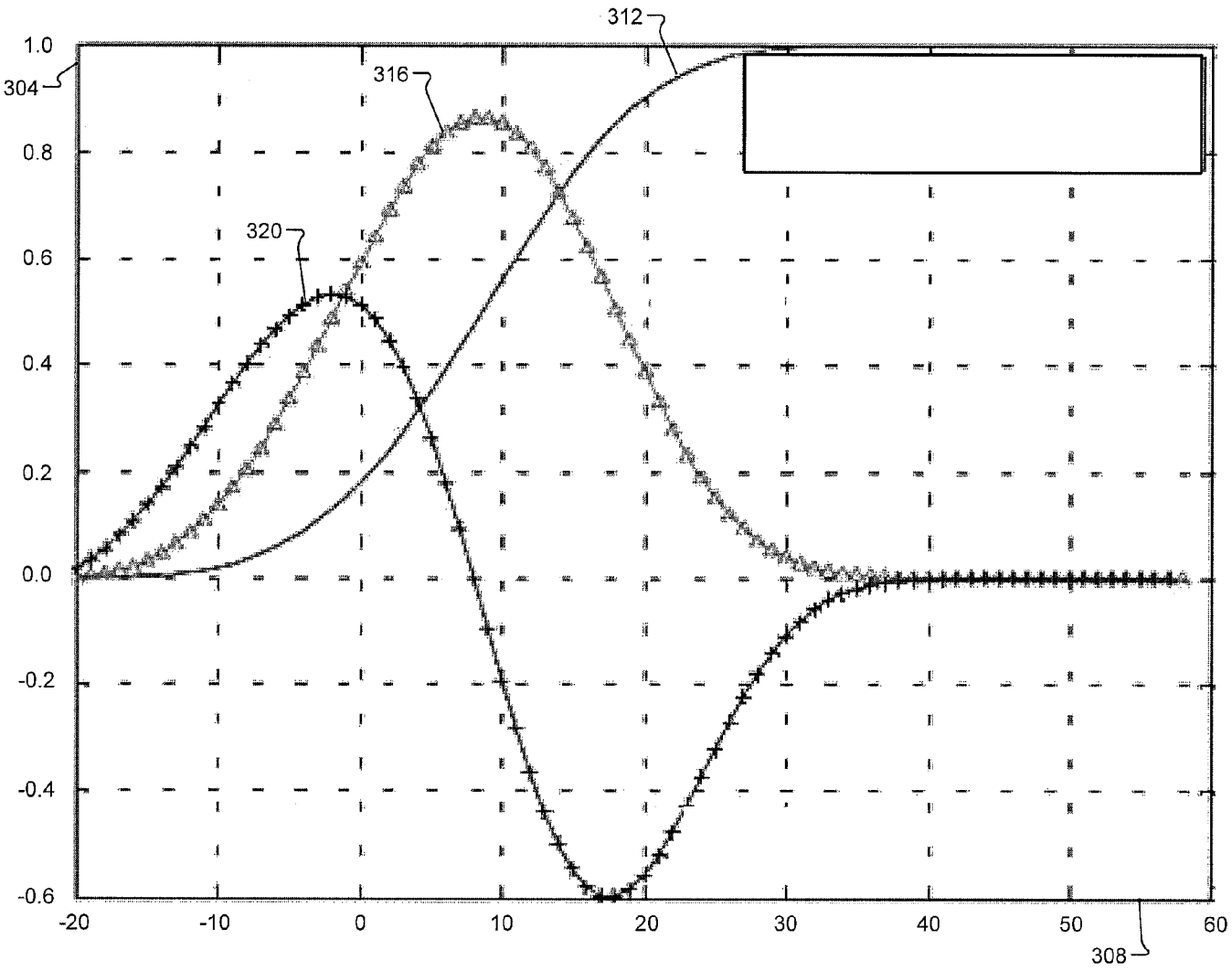
FIG. 3 includes an example graph of mass fraction burned (MFB) and first and second derivatives of the MFB versus crankshaft angle for a combustion event.

FIG. 3 includes an example graph of mass fraction burned (MFB) 304 versus crankshaft angle (CA) 308 for a combustion event of an engine. Trace 312 tracks the MFB. Trace 316 tracks a first order derivative of the MFB 312, and trace 320 tracks a second order derivative of the MFB 312. The first order derivative of the MFB 312 corresponds to burn velocity. The second order derivative of the MFB 12 corresponds to burn acceleration.

Spark for the combustion event is generated, and therefore combustion of fuel begins, at approximately 20 degrees before top dead center in the example of FIG. 3. This spark timing is provided as an example only, and different spark timings may be used. In the example of FIG. 3, the CA of 0 indicates top dead center.

Various CAs where predetermined MFBs occur may be of particular relevance. For example, the CA where 50 percent of an amount of fuel has been burned (MFB=0.5) during a combustion event may be referred to as a CA50 value. The CA where 10 percent of an amount of fuel has been burned (MFB=0.1) may be referred to as a CA10 value. The CA where 75 percent of an amount of fuel has been burned (MFB=0.75) may be referred to as a CA75 value. The CA where 90 percent of an amount of fuel has been burned (MFB=0.9) may be referred to as a CA90 value. These CAs are provided as examples only, and other CAs corresponding to other predetermined MFBs may additionally or alternatively be of relevance.

Referring back to FIG. 2, a parameter determination module 232 determines an M index value for the Wiebe function. As discussed further below, the parameter determination module 232 determines the M index value based on a ratio of a first CA difference between first and second CAs of the combustion event to a second CA difference between third and fourth CAs of the combustion event.

The parameter determination module 232 also determines other parameters for the combustion event based on the M index value. For example, the parameter determination module 232 may determine a CA where a maximum burn velocity occurred during the combustion event, a CA where a maximum burn acceleration occurred during the combustion event, and a CA where a minimum burn acceleration occurred during the combustion event.

Figure 4:
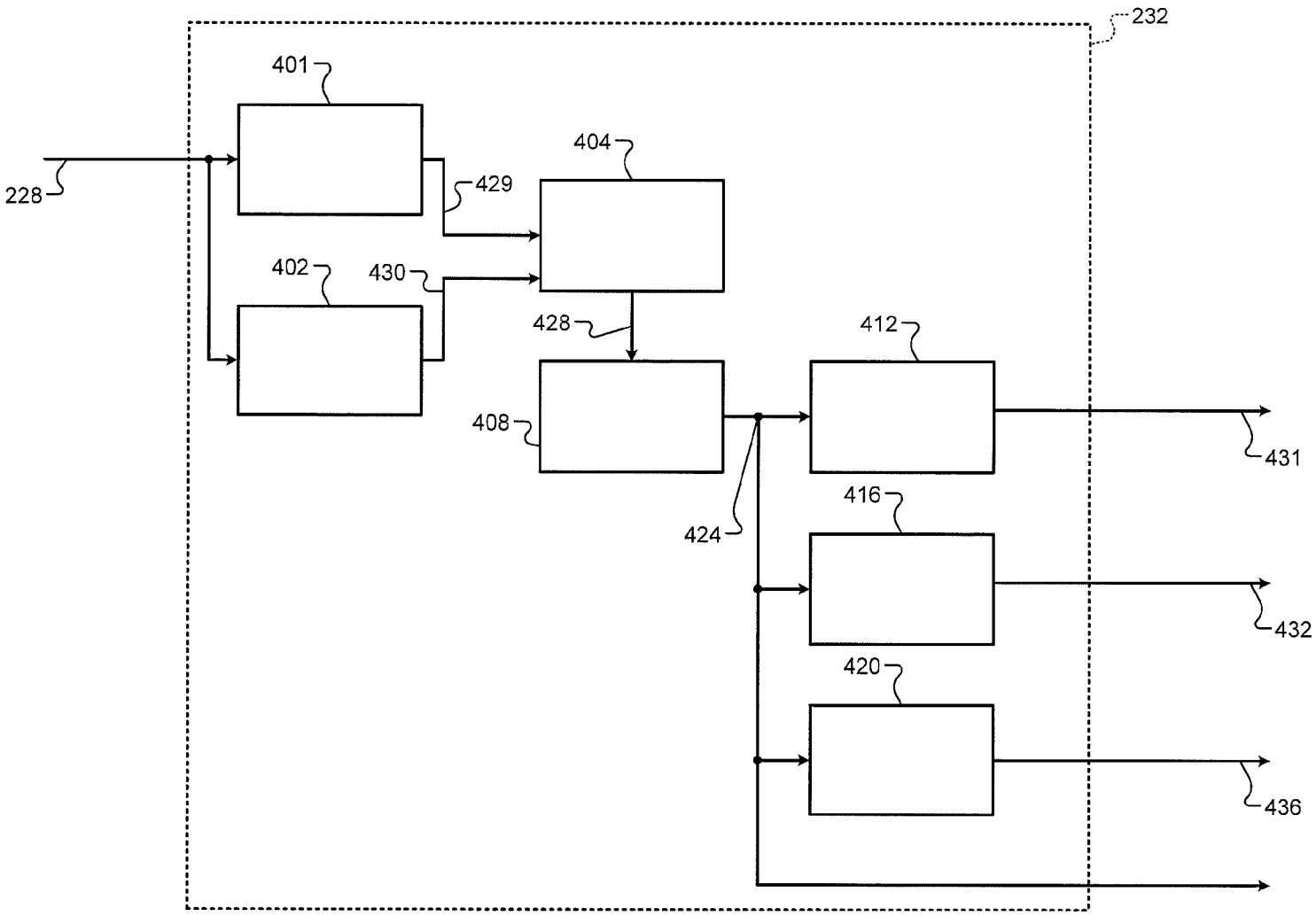
FIG. 4 is a functional block diagram of an example parameter determination module.

Referring now to FIG. 4, a functional block diagram of an example implementation of the parameter determination module 232 is presented. The parameter determination module 232 includes a first difference module 401, a second difference module 402, a ratio module 404, an M index module 408, a maximum velocity module 412, a maximum acceleration module 416, and a minimum acceleration module 420.

The Wiebe function can be written in equation form as:

$$MFB(\theta) = 1 - \exp\left(-a\left(\frac{\theta - \theta_0}{\Delta\theta}\right)^{m+1}\right),$$

where MFB(θ) is the MFB at a given CA (θ), exp denotes use of the natural exponential function (e), a is a predetermined constant value, $\theta_0$ is (CA of) the spark timing, Δθ is the total burn duration and corresponds to a CA difference between the CA of the spark timing $\theta_0$ and the CA at the end of the combustion event, and m is the M index value. The M index module 408 determines an M index value 424 for a combustion event based on a burn duration ratio 428 of the combustion event.

The ratio module 404 determines the burn duration ratio 428 based on a ratio of: a first CA difference 429 between first and second CAs of the combustion event; to a second CA difference 430 between third and fourth CAs of the combustion event. The first difference module 401 determines the first and second CAs and determines the first CA difference 429 between the first and second CAs. The second difference module 402 determines the third and fourth CAs and determines the second CA difference 430 between the third and fourth CAs.

The first and second difference modules 401 and 402 determine the first, second, third, and fourth CAs for a combustion event from the mapping 228 stored for the combustion event. The first and second difference modules 401 and 402 may identify one or more of the first, second, third, and fourth CAs from the mapping 228 corresponding to predetermined MFBs, respectively.

For example only, the first CA may be the CA where the MFB of 0.1 (corresponding to 10 percent of the total mass of fuel) occurred during the combustion event. In other words, the first CA may be the CA10 of the combustion event. The second CA may be the CA where the MFB of 0.75 (corresponding to 75 percent of the total mass of fuel) occurred during the combustion event. In other words, the second CA may be the CA75 of the combustion event. The third CA may be the CA where spark was generated (i.e., the spark timing) for the combustion event. The fourth CA may be the CA where the MFB of 0.5 (corresponding to 50 percent of the total mass of fuel) occurred during the combustion event. In other words, the fourth CA may be the CA50 of the combustion event.

Using the above examples, the first CA difference may correspond to the CA difference between the CA10 of the combustion event and the CA75 of the combustion event. The second CA difference may correspond to the CA difference between the spark timing of the combustion event and the CA50 of the combustion event. While the examples of CA10, CA75, spark timing, and CA50 have been provided, the present application is also applicable to determining the M index value 424 based on the ratio of first and second differences involving one or more different CAs.

As stated above, the ratio module 404 determines the burn duration ratio 428 based on the ratio of the first CA difference 429 to the second CA difference 430. More specifically, the ratio module 404 sets the burn duration ratio 428 based on or equal to the first CA difference 429 divided by the second CA difference 430.

The M index module 408 determines the M index value 424 based on the burn duration ratio 428. For example, the M index module 408 may determine the M index value 424 using one of a function and a mapping that relates burn duration ratios to M index value. In the case of a mapping, the M index module 408 may interpolate when the burn duration ratio 428 is between two burn duration ratios (corresponding to two M index values) in the mapping.

An example mapping of burn duration ratios and corresponding M index values is provided below.

| M Index | Burn Duration Ratio |
|---|---|
| 0.5 | 1.3026 |
| 1 | 1.0245 |
| 1.5 | 0.8489 |
| 2 | 0.7263 |
| 2.5 | 0.6353 |
| 3 | 0.5649 |
| 3.5 | 0.5087 |
| 4 | 0.4627 |
| 4.5 | 0.4244 |
| 5 | 0.392 |
| 5.5 | 0.3643 |
| 6 | 0.3401 |
| 6.5 | 0.3191 |
| 7 | 0.3004 |
| 7.5 | 0.2839 |
| 8 | 0.269 |
| 8.5 | 0.2556 |

The example mapping includes M index values and corresponding burn duration ratios where the burn duration ratio is calculated using the examples of the first, second, third, and fourth CAs provided above. The entries of the mapping are calibrated based on the particular CAs used to determine the burn duration ratio.

The maximum velocity module 412 determines a maximum velocity CA 431 based on the M index value 424. The maximum velocity CA 431 corresponds to the CA where a maximum (largest) burn velocity occurred during the combustion event. The maximum velocity module 412 determines the maximum velocity CA 431 further based on the spark timing of the combustion event. The maximum velocity module 412 may determine the maximum velocity CA 431 using a function or a mapping that relates spark timings and M index values to maximum velocity CAs. For example, the maximum velocity module 412 may set the maximum velocity CA 431 using the equation:

$$\mathrm{Max}VCA = \left(\frac{m}{a(m+1)}\right)^{\frac{1}{m+1}} * \theta_0,$$

where Max V CA is the maximum velocity CA 431, m is the m index value 424, a is the predetermined constant value, and $\theta_0$ is the spark timing.

The maximum acceleration module 416 determines a maximum acceleration CA 432 based on the M index value 424. The maximum acceleration CA 432 corresponds to the CA where a maximum (largest) burn acceleration occurred during the combustion event. The maximum acceleration module 416 determines the maximum acceleration CA 432 further based on the spark timing of the combustion event. The maximum acceleration module 416 may determine the maximum acceleration CA 432 using a function or a mapping that relates spark timings and M index values to maximum acceleration CAs. For example, the maximum acceleration module 416 may set the maximum acceleration CA 432 using the equation:

$$\mathrm{Max}AccCA = \left(\frac{3m - \sqrt{9m^2 - 4m(m-1)}}{2a(m+1)}\right)^{\frac{1}{m+1}} * \theta_0,$$

where Max Acc CA is the maximum acceleration CA 432, m is the m index value 424, a is the predetermined constant value, and $\theta_0$ is the spark timing.

The minimum acceleration module 420 determines a minimum acceleration CA 436 based on the M index value 424. The minimum acceleration CA 436 corresponds to the CA where a minimum (smallest) burn acceleration occurred during the combustion event. The minimum acceleration module 420 determines the minimum acceleration CA 436 further based on the spark timing of the combustion event. The minimum acceleration module 420 may determine the minimum acceleration CA 436 using a function or a mapping that relates spark timings and M index values to minimum acceleration CAs. For example, the minimum acceleration module 420 may set the minimum acceleration CA 436 using the equation:

$$\mathrm{Min}AccCA = \left(\frac{3m + \sqrt{9m^2 - 4m(m-1)}}{2a(m+1)}\right)^{\frac{1}{m+1}} * \theta_0,$$

where Min Acc CA is the minimum acceleration CA 436, m is the m index value 424, a is the predetermined constant value, and $\theta_0$ is the spark timing.

The parameter determination module 232 outputs the M index value 424, the maximum velocity CA 431, the maximum acceleration CA 432, and the minimum acceleration CA 436. For example, the parameter determination module 232 may display the M index value 424, the maximum velocity CA 431, the maximum acceleration CA 432, and the minimum acceleration CA 436 on a display (not shown).

Figure 5:
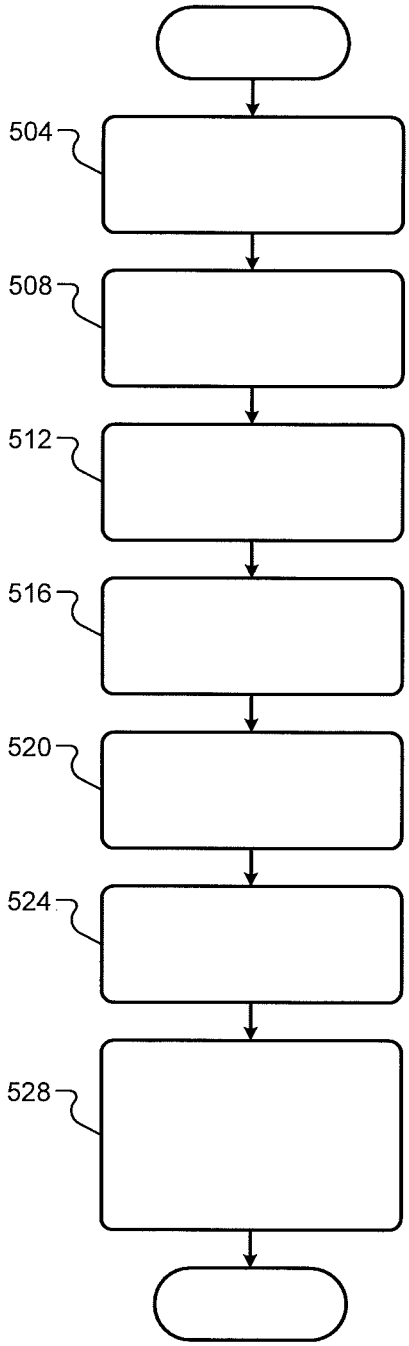
FIG. 5 is a flowchart depicting an example method of generating the M index value for a combustion event.

FIG. 5 is a flowchart depicting an example method of generating the M index value 424, the maximum velocity CA 431, the maximum acceleration CA 432, and the minimum acceleration CA 436 of a combustion event. Control begins with 504 where the mapping module 224 records operating parameters of the engine 208 measured by the sensors 216 during a combustion event of the engine 208 during use with the dynamometer 212. The mapping module 224 generates the mapping 228 for the combustion event based on the recorded operating parameters at 508. The mapping 228 includes MFB values at various CAs, respectively, during the combustion event. The mapping 228 also includes the spark timing used for the combustion event.

At 512, the first and second difference modules 401 and 402 determine the first, second, third, and fourth CAs for the combustion event. For example, the first CA may correspond to the CA where an MFB of 0.1 occurred during the combustion event. The second CA may correspond to the CA where an MFB of 0.75 occurred during the combustion event. The third CA may correspond to the spark timing used for the combustion event. The fourth CA may correspond to the CA where an MFB of 50 occurred during the combustion event.

At 516, the first difference module 401 determines the first CA difference 429 between the first and second CAs, and the second difference module 402 determines the second CA difference 430 between the third and fourth CAs. For example, the first difference module 401 may set the first CA difference 429 equal to or based on the second CA minus the first CA. The second difference module 402 may set the second CA difference 430 equal to or based on the fourth CA minus the third CA.

At 520, the ratio module 404 determines the burn duration ratio 428 for the combustion event based on the ratio of the first CA difference 429 to the second CA difference 430. For example, the ratio module 404 may set the burn duration ratio 428 equal to the first CA difference 429 divided by the second CA difference 430.

The M index module 408 determines the M index value 424 for the combustion event based on the burn duration ratio 428 for the combustion event at 524. For example, the M index module 408 may determine the M index value 424 using one of a function and a mapping that relates burn duration ratios to M index values.

At 528, one or more other parameters may be determined based on the M index value 424. For example, the maximum velocity module 412 may determine the maximum velocity CA 431 for the combustion event based on the spark timing for the combustion event and the M index value 424 for the combustion event. Additionally or alternatively, the maximum acceleration module 416 may determine the maximum acceleration CA 432 for the combustion event based on the spark timing for the combustion event and the M index value 424 for the combustion event. Additionally or alternatively, the minimum acceleration module 420 may determine the minimum acceleration CA 436 for the combustion event based on the spark timing for the combustion event and the M index value 424 for the combustion event. One or more of the determined parameters may be displayed on a display to aid in the vehicle design process. While the example of FIG. 5 is shown as ending after 528, the example of FIG. 5 may be performed for multiple combustion events.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A parameter determination system comprising:

a first difference module that determines a first crankshaft angle of a combustion event of an engine, that determines a second crankshaft angle of the combustion event of the engine, and that determines a first difference between the first and second crankshaft angles;

a second difference module that determines a third crankshaft angle of the combustion event of the engine, that determines a fourth crankshaft angle of the combustion event of the engine, and that determines a second difference between the third and fourth crankshaft angles;

a ratio module that determines a ratio of the first difference to the second difference; and an M index module that determines an M index value for the Wiebe function based on the ratio and that displays the M index value on a display.

2. The parameter determination system of claim 1 wherein the ratio module sets the ratio equal to the first difference divided by the second difference.

3. The parameter determination system of claim 1 wherein the first difference module sets the first crankshaft angle based on a crankshaft angle where a mass fraction burned of 0.1 occurred during the combustion event.

4. The parameter determination system of claim 1 wherein the first difference module sets the second crankshaft angle based on a crankshaft angle where a mass fraction burned of 0.75 occurred during the combustion event.

5. The parameter determination system of claim 1 wherein the second difference module sets the third crankshaft angle to a spark timing used for the combustion event.

6. The parameter determination system of claim 1 wherein the second difference module sets the fourth crankshaft angle based on a crankshaft angle where a mass fraction burned of 0.5 occurred during the combustion event.

7. The parameter determination system of claim 1 wherein the first difference module sets the first crankshaft angle based on a crankshaft angle where a mass fraction burned of 0.1 occurred during the combustion event and sets the second crankshaft angle based on a crankshaft angle where a mass fraction burned of 0.75 occurred during the combustion event, and wherein the second difference module sets the third crankshaft angle to a spark timing used for the combustion event and sets the fourth crankshaft angle based on a crankshaft angle where a mass fraction burned of 0.5 occurred during the combustion event.

8. The parameter determination system of claim 1 further comprising a maximum velocity module that determines a crankshaft angle where a maximum velocity occurred during the combustion event based on the M index value.

9. The parameter determination system of claim 1 further comprising a maximum acceleration module that determines a crankshaft angle where a maximum acceleration occurred during the combustion event based on the M index value.

10. The parameter determination system of claim 1 further comprising a minimum acceleration module that determines a crankshaft angle where a minimum acceleration occurred during the combustion event based on the M index value.

11. A parameter determination method, comprising:

determining a first crankshaft angle of a combustion event of an engine;

determining a second crankshaft angle of the combustion event of the engine;

determining a first difference between the first and second crankshaft angles;

determining a third crankshaft angle of the combustion event of the engine;

determining a fourth crankshaft angle of the combustion event of the engine;

determining a second difference between the third and fourth crankshaft angles;

determining a ratio of the first difference to the second difference;

determining an M index value for the Wiebe function based on the ratio; and displaying the M index value on a display.

12. The parameter determination method of claim 11 further comprising setting the ratio equal to the first difference divided by the second difference.

13. The parameter determination method of claim 11 further comprising setting the first crankshaft angle based on a crankshaft angle where a mass fraction burned of 0.1 occurred during the combustion event.

14. The parameter determination method of claim 11 further comprising setting the second crankshaft angle based on a crankshaft angle where a mass fraction burned of 0.75 occurred during the combustion event.

15. The parameter determination method of claim 11 further comprising setting the third crankshaft angle to a spark timing used for the combustion event.

16. The parameter determination method of claim 11 further comprising setting the fourth crankshaft angle based on a crankshaft angle where a mass fraction burned of 0.5 occurred during the combustion event.

17. The parameter determination method of claim 11 further comprising:

setting the first crankshaft angle based on a crankshaft angle where a mass fraction burned of 0.1 occurred during the combustion event;

setting the second crankshaft angle based on a crankshaft angle where a mass fraction burned of 0.75 occurred during the combustion event;

setting the third crankshaft angle to a spark timing used for the combustion event; and setting the fourth crankshaft angle based on a crankshaft angle where a mass fraction burned of 0.5 occurred during the combustion event.

18. The parameter determination method of claim 11 further comprising determining a crankshaft angle where a maximum velocity occurred during the combustion event based on the M index value.

19. The parameter determination method of claim 11 further comprising determining a crankshaft angle where a maximum acceleration occurred during the combustion event based on the M index value.

20. The parameter determination method of claim 11 further comprising determining a crankshaft angle where a minimum acceleration occurred during the combustion event based on the M index value.

* * * * *